US005534137A

United States Patent [19]

Griggs et al.

[11] Patent Number: 5,534,137

[45] Date of Patent: Jul. 9, 1996

[54] PROCESS FOR DE-ASHING COAL TAR

[75] Inventors: E. Sean Griggs; William R. Roder, both of Indianapolis, Ind.

[73] Assignee: Reilly Industries, Inc., Indianapolis, Ind.

[21] Appl. No.: 215,010

[22] Filed: Mar. 21, 1994

Related U.S. Application Data

[63] Continuation of Ser. No. 69,121, May 28, 1993, abandoned.

[51] Int. Cl.[6] ..... C10G 1/00; C10C 1/00; C10C 1/04

[52] U.S. Cl. ..... 208/425; 208/424; 208/39; 208/41

[58] Field of Search ..... 208/424, 425, 208/39, 41; 210/787

[56] References Cited

U.S. PATENT DOCUMENTS

| | | | |
|---|---|---|---|
| 4,259,171 | 3/1981 | Stadelhofer et al. | 208/45 |
| 4,436,615 | 3/1984 | Boodman et al. | 208/39 |
| 4,517,072 | 5/1985 | Cukier et al. | 208/22 |
| 4,640,761 | 2/1987 | Mori et al. | 208/44 |
| 4,864,942 | 9/1989 | Fochtman et al. | 110/226 |
| 4,961,391 | 10/1990 | Mak et al. | 110/346 |
| 4,986,895 | 1/1991 | Mori et al. | 208/39 |
| 5,128,021 | 7/1992 | Romey et al. | 208/39 |

*Primary Examiner*—Asok Pal
*Assistant Examiner*—Patricia L. Hailey
*Attorney, Agent, or Firm*—Woodard, Emhardt, Naughton, Moriarty & McNett

[57] ABSTRACT

Described are novel processes for treating high-ash coal tars to produce coal tars which are suitable for distillation to form binder pitch. Preferred processes of the invention involve multi-stage centrifugations to reduce ash and preferably also quinoline insoluble levels. Processes of the invention also provide for the treatment of coal tar sludges to recover valuable coal tar distillate and dried, free-flowing coal related material having high fuel value.

17 Claims, No Drawings

PROCESS FOR DE-ASHING COAL TAR

This application is a continuation of application Ser. No. 08/069,121, filed May 28, 1993, now abandoned.

BACKGROUND

The present invention relates generally to the processing of coal tar, and in particular to the treatment of a high-solids coke oven coal tar to remove ash and other solids and recover a modified coal tar suitable for distillation to produce binder pitch.

As further background, coal tars are generated as by-products of coking processes in the steel industry. Coal tars are complex chemical mixtures containing aromatic chemicals and various solids, and their particular composition varies widely depending largely upon the coking process by which they are produced. Some modern coking processes lead to coal tars having very high solids contents. These tars are problematic because they are unsuitable for customary uses for coal tars and thus can generate high disposal costs.

Two important solid components of coal tars are ash and quinoline insoluble ("QI") components. Ash is generally known in the coal tar industry as the noncarbonaceous inorganic contaminant component of coal tar with a typical particle size greater than about 25 micrometers, with the major ash component being silicon. On the other hand, QI components are fine carbonaceous particles, generally 1 micrometer or less in particle size.

One use for coal tar is for the production of binder pitch which in turn is used in large volumes in the aluminum industry in the preparation of anodes. The binder pitch is prepared by distillation of the coal tar. To be suitable for distillation to binder pitch, a coal tar must have defined levels of ash and QI components. However, as noted above, some modern coking operations produce high-solids coal tars which have high levels of ash and QI components—levels that are far too high to be useful to prepare binder pitch. As such, there is a need for a process for treating ash-containing high-solids coal tars to produce modified coal tars that are suitable for the production of binder pitch. Such a process should be practicable on a large scale and maximize recovery of valuable products from the treated tars. The present invention addresses these needs.

SUMMARY OF THE INVENTION

In accordance with the present invention it has been discovered that coal tars, even extraordinarily high-solids and high-ash coal tars, can be subjected to a centrifugation at very high G forces (herein sometimes referred to as a "high-speed centrifugation") to dramatically reduce ash, QI and other solids levels, and produce a coal tar suited for use in the production of binder pitch. Accordingly, one preferred embodiment of the invention provides a process for treating an ash-containing coal tar to remove ash therefrom. The process includes the steps of (i) subjecting an ash-containing initial coal tar to centrifugation at a centrifugal force of about 5000 G's or greater so as to separate the coal tar into a first fraction having a reduced level of ash as compared to the initial coal tar and a second fraction having an increased level of ash compared to the initial tar, and, (ii) recovering the first fraction from the centrifugation. The high-speed centrifugation is advantageously carried out in a solids-ejecting, disk-stack centrifuge capable of generating 5000 G's or greater of centrifugal force. The high-speed centrifugation can be the first (and optionally only) centrifugation used in the treatment of the coal tar; however, in preferred processes, two or more centrifugation steps are used. For instance, processes of the invention can include a first centrifugation at a relatively lower G force (a "lower speed centrifugation") as compared to the high speed centrifugation, to provide an intermediate tar having a reduced ash level compared to the starting tar. The intermediate tar can then be subjected to one or more additional centrifugations, at least one of which is a high speed centrifugation as discussed above, to provide a finished coal tar with the desired characteristics. The lower speed centrifugation may be conducted at a centrifugal force, for example, of about 1000 G's or greater and typically in the range of about 1000 G's to about 4000 G's. The lower speed centrifugation can be carried out to advantage in a continuous decanter centrifuge.

Another preferred embodiment of the present invention provides a process for treating a coal tar sludge. This process includes the step of providing a coal tar sludge which is a by-product of the treatment of coal tar to remove solids therefrom. The sludge is charged to a thermal desorption unit such as a rotary kiln or rotary calcined and therein treated at a temperature of at least about 200° C. so as to remove volatile organic compounds therefrom. The volatile organic compounds are condensed to recover a valuable coal tar distillate. A dry, carbonaceous material is recovered from the thermal desorption unit, and has use for its fuel value.

A further preferred embodiment of the invention provides a process for preparing a coal tar pitch suitable for use as an anode binder. The process includes the steps of (i) subjecting an ash-containing coal tar to centrifugation at a centrifugal force of about 5000 G's or greater so as to separate the coal tar into a first fraction having a reduced level of ash as compared to the coal tar starting material and a second fraction having an increased level of ash compared to the starting material, (ii) recovering the first fraction from the centrifugation, and (iii) distilling the first fraction to produce the coal tar pitch. More preferred modes of carrying out this embodiment of the invention include the use of multiple-step centrifugations as highlighted in connection with the first-mentioned embodiment above.

A still further preferred embodiment of the invention provides a process for treating an ash-containing coal tar to recover coal tar-related products therefrom. The process includes the steps of (i) subjecting an ash-containing coal tar to centrifugation at a centrifugal force of about 5000 G's or greater so as to separate the coal tar into a first fraction having a reduced level of ash as compared to the coal tar starting material and a second fraction having an increased level of ash compared to the starting material; (ii) recovering the first fraction from the centrifugation; (iii) distilling the first fraction to produce coal tar pitch and coal tar distillate; (iv) recovering the second fraction (a coal tar sludge); (v) treating the coal tar sludge in a thermal desorption unit at a temperature of at least about 200° C. so as to remove volatile organic compounds therefrom; (vi) condensing the volatile organic compounds to recover a coal tar distillate; and (vii) recovering from the thermal desorption unit a dry, carbonaceous material. As to advantages, processes of the invention convert high-ash coal tars to coal tars suitable for production of anode binder pitch. The processes can employ relatively low temperatures and can be economically practiced on a large scale. Processes of the invention also provide the production of condensables with chemical resource values, and further produce free flowing, friable, solid carbonaceous product which has fuel value. Additional objects, features and advantages of the invention will be apparent from the following description.

DESCRIPTION OF THE PREFERRED EMBODIMENT

For the purposes of promoting an understanding of the principles of the invention, reference will now be made to certain embodiments thereof and specific language will be used to describe the same. It will nevertheless be understood that no limitation of the scope of the invention is thereby intended, such alterations, further modifications, and applications of the principles of the invention as described herein being contemplated as would normally occur to one skilled in the art to which the invention relates.

As indicated above, one embodiment of the present invention relates to the treatment of an ash-containing coal tar to produce a coal tar that is suitable for use in the production of anode binder pitch. In processes of the invention, high-solids coal tars are preferably subjected to multiple centrifugations, more preferably a two-stage centrifugation. An initial centrifugation will be at a relatively low centrifugal force and will remove a portion of the ash and other solids. At least one subsequent centrifugation will be at a relatively higher centrifugal force so as to remove additional ash and other solids. The coal tar thus produced is suitable for use in the preparation of anode binder pitch and valuable coal tar distillates. Further, the solids-laden sludge materials removed by the centrifugation steps (i.e. the "underflow") can be treated to produce a dry, friable free-flowing carbonaceous material that has fuel value and a coal tar distillate having chemical value.

The present invention is applied with preference to a coke oven coal tar having an ash content of about 0.6 percent by weight or greater, and often about 0.75 percent by weight or greater. Other solids levels in the coal tar can also be high. For example, the QI content of the coke oven coal tar will usually be about 15 percent by weight or greater, and typically about 20 percent by weight or greater. To illustrate high solids coal tars to which the invention can be applied, Tables 1–3 below set forth the physical, petrographic and chemical properties of high-solids coal tars, HS-1 and HS-2, as compared to a typical coal tar.

TABLE 1

| | Physical Properties | | |
|---|---|---|---|
| | HS-1 | HS-2 | Typical Tar |
| % $H_2O$ | 0.00 | 0.00 | 2.0 (By Karl Fischer) |
| % Ash | 0.80 | 1.02 | 0.15 (ASTM D2415) |
| % Q.I. | 17.11 | 19.96 | 8.0 (ASTM D2318) |
| % Coking Value | N/A* | 45.57 | 35.0 (ASTM D2416) |
| Specific Gravity 25/25° C. | 1.259 | 1.266 | 1.190 |
| IR-Index | N/A | 0.37 | 0.40 (Analytical Method 82-7A) |
| Viscosity, 190° F., #2 20 rpm in cps | 430 | 860 | 50 (BrookField) |
| Na (ppm) | 58 | 117 | 150 (By A.A.**) |
| Fe (ppm) | 590 | 630 | 200 (By A.A.) |
| Si (ppm) | 1,860 | 2,470 | 225 |
| % S | 0.61 | N/A | 0.7 |
| Chloride (ppm) | N/A | N.D | 200 |
| Cyanide (ppm) | N/A | <.25 | N/A |
| B.T.U./LB | N/A | 16,084 | 15,000 (ASTM D20) |
| Distillation | | | |
| To - 170° C. | 0.00% | N/A | 0.4% |
| To - 210° C. | 0.83% | | 1.13% |

TABLE 1-continued

| | Physical Properties | | |
|---|---|---|---|
| | HS-1 | HS-2 | Typical Tar |
| To - 235° C. | 2.01% | | 6.00% |
| To - 270° C. | 6.47% | | 14.40% |
| To - 315° C. | 14.00% | | 23.01% |
| To - 355° C. | 24.66% | | 32.65% |
| Residue | 74.47% | | 65.77% |
| Softening Point | 89.0° C. | | 77.3° C. (R&B ASTM D36) |
| Relative Density 25° C. | 1.250 | | N/A (ASTM D71) |
| % Q.I. of pitch | 20.36% | | 10.87% (ASTM D2318) |
| % Ash of pitch | 1.08% | | 0.22% (ASTM D2415) |

*N/A = not analyzed
**A.A. = atomic absorption

TABLE 2

| | Petrographic Properties (Volume Percent) | | |
|---|---|---|---|
| Component | HS-1 | Typical Coal Tar | Particle Size |
| Normal Q.I. | 26.2 | 76.5 | 0.25–1.0 |
| Coarse Q.I. | 10.4 | 12.0 | 1.0–2.0 |
| Mesophase Q.I. | 1.2 | 0.0 | >4.0 |
| Hard Pitch | 1.5 | 0.0 | >4.0 |
| Spheres | 0.8 | 0.0 | >4.0 |
| Fine Pyrolytic | 2.3 | 3.0 | 2.0–4.0 |
| Coarse Pyrolytic | 1.5 | 1.5 | >4.0 |
| Pitch Coke Normal | 2.5 | 0.4 | >4.0 |
| Pitch Coke Green | 1.9 | 0.2 | >4.0 |
| Normal Coke Cenosphere | 9.6 | 2.7 | 5–600 |
| Green Coke Cenosphere | 4.1 | 2.1 | 5–600 |
| Normal Coke | 1.9 | 0.2 | 5–600 |
| Green Coke | 1.0 | 0.0 | 5–600 |
| Coal | 34.3 | 1.0 | 5–600 |
| Minerals- Coal Related | 0.4 | 0.0 | 5–600 |
| Minerals- Non Coal Related | 0.4 | 0.4 | 5–600 |

TABLE 3

| | Chemical Composition | | |
|---|---|---|---|
| | Weight Percent | | Typical |
| Component | HS-1 | HS-2 | Coal Tar |
| Phenol (total tar acids) | 0.24 (0.88) | 0.26 (0.61) | 0.72 (2.86) |
| Naphthalene | 11.56 | 12.72 | 14.92 |
| 1-Methylnaphthalene | 1.42 | 1.51 | 2.62 |
| 2-Methylnaphthalene | 0.71 | 0.65 | 1.21 |
| Acenaphthene | 0.80 | 1.02 | 3.74 |
| Dimethylnaphthalene | 2.08 | 2.68 | 1.32 |
| Fluorene | 3.18 | 3.57 | 2.63 |
| Phenanthrene | 12.44 | 14.07 | 6.15 |
| Anthracene | 2.67 | 3.05 | 2.30 |
| Carbazole | 1.67 | 1.98 | 0.89 |
| Fluoranthene | 8.88 | 9.42 | 3.86 |
| Pyrene | 7.46 | 7.62 | 4.29 |
| Chrysene | 3.29 | 3.52 | 2.70 |
| Triphenylene | 3.19 | 2.51 | 2.90 |
| Benzo(a)pyrene | 3.79 | 3.80 | 2.35 |
| Benzo(k)flouranthene | 2.42 | 2.21 | 1.21 |

As can be seen, the illustrative high-solids coal tars comprise 0.80 and 1.02 weight percent ash, respectively, whereas the typical tar is much lower at 0.15 weight percent ash. The high-solids coal tars also have much higher QI contents of 17.11 and 19.96 weight percent, respectively, as compared to 8.0 weight percent for the typical coal tar. It can also be seen from the Tables that other solids contents are higher for the high-solids coal tar as compared to the typical coal tar, and that average particle sizes of solids in the HS-1 and HS-2 tars are generally larger than in the typical tar. The high-solids coke oven coal tars thus present unique problems in treatment, but are nevertheless advantageously treated in accordance with processes of the present invention.

More preferred processes of the invention are performed by first subjecting the ash-containing coal tar to a first centrifugation at a centrifugal force of about 1000 G's or greater to form a first fraction (an intermediate coal tar) having a reduced level (e.g. weight percent) of ash as compared to the starting coal tar and a second fraction with an increased level of ash. Preferably, the first centrifugation will be at a centrifugal force in the range of about 1000–4000 G's, more preferably in the range of about 2000–4000 G's. Also preferably, the first centrifugation will be conducted so that the intermediate tar has an ash level about 10 percent or more reduced as compared to the starting tar, more preferably at least about 25 percent reduced, e.g. in the range of about 25 to about 50 percent and most preferably about 40 to about 50 percent reduced. Broadly speaking, the temperature of the coal tar during the centrifuging will be sufficiently high to maintain the coal tar as a flowable mass and achieve the desired separation of solids. Preferably, the temperature of the coal tar during the centrifuging will be above about 50° C., more preferably in the range of about 50° C. to 150° C. and most preferably in the range of about 80° C. to about 130° C. Optionally, the coal tar can be blended with a solvent to reduce its viscosity and in this instance, of course, the temperature of the tar during the centrifugation may generally be lower. The solvent, if used, will usually be blended with the tar in up to about a one to one volumetric ratio. Whether to use a solvent and if so the amount to be used will depend upon several factors such as the desired temperature during centrifugation, the level of separation desired, and the particular economics at hand with respect to solvent cost, ease of solvent recovery and reuse, and the like. When used, the solvent is preferably a coal tar distillate.

Typically, intermediate tar from the first centrifugation will have a QI level that is also reduced as compared to the starting tar. In this regard, in preferred processes, the intermediate tar will have a QI level at least about 10 percent reduced, and in more preferred processes at least about 20 percent reduced.

Levels of other solid components in the starting coal tar will also typically be reduced by the first centrifugation. Thus, generally speaking, the first centrifugation will provide an intermediate tar having a total solids level at least about 10 percent reduced as compared to the starting tar and in preferred processes about 30 to about 50 percent reduced. Correspondingly, the intermediate tar will usually constitute about 90 to 95 weight percent of the charged starting tar material, and the separated coal tar sludge will constitute about 5 to about 10 percent by weight of the charged starting tar material.

The first centrifugation is advantageously conducted in a continuous decanter centrifuge such as that available from Alfa-Laval under Model No. CHNX418. In this regard, a decanter centrifuge is a sedimenting centrifuge which has a generally cylindrical drum (or "bowl") and an axial screw conveyer or scroll housed within the drum. The drum and scroll are spun at differential speeds such that the scroll pushes settled solids toward discharge openings located at a tapered end of the drum. The drum of the centrifuge also preferably has axial ribs or grooves to prevent the contents of the bowl from slipping due to the action of the scroll. For additional information as to decanter centrifuges, reference can be made to product literature available from Alfa-Laval including "Super-D-Canter Continuous Solid Bowl Centrifuges" No PM 47000 E2, 90 05; and "The Alfa-Laval Decanter Centrifuge" PC 40631E2, 8609.

As indicated, the coal tar centrifugate or intermediate coal tar from the first centrifugation will usually represent about 90 to about 95 percent by weight of the charged coal tar material. The intermediate tar is recovered, for example as an effluent stream, and then subjected to one or more further centrifugations, at least one of which is at a relatively high centrifugal force so as to provide a finished coal tar which is suitable for use in the production of binder pitch. In this second centrifugation step, the intermediate coal tar is centrifuged at a centrifugal force of about 5000 G's or greater, typically within the range of about 5000 G's to about 10,000 G's, and more preferably in the range of about 6000 G's to 8000 G's. While being fed to the second centrifuge, the tar will be maintained at a temperature sufficient to render it a flowable mass, preferably above about 50°, more preferably in the range of about 50°to about 150° C. and most preferably in the range of about 80° C. to about 130° C. It is advantageous to feed the intermediate coal tar to the second centrifuge while it retains at least a portion of the heat imparted to it during the first centrifugation.

As with the first centrifugation, during the high-speed centrifugation the coal tar will be at a temperature that is sufficient to maintain the coal tar as a flowable mass so as to achieve the desired separation of solids. The second centrifugation is also preferably conducted with the coal tar at a temperature above about 50° C., usually within the range of about 50° C. to about 150° C., and most preferably in the range of about 80° C. to about 130° C. Likewise, the coal tar may be blended with a solvent during the high-speed centrifugation. The solvent during the high-speed centrifugation may be remaining solvent from the first centrifugation or may be added subsequent to the first centrifugation, or may be a combination thereof. Again, the solvent, if used, is preferably a coal tar distillate.

The high-speed centrifugation will provide a finished coal tar having an ash level that is reduced as compared to the intermediate coal tar. In this regard, ash levels of finished tars are typically at least about 10 percent reduced as compared to the intermediate tar, preferably at least about 25 percent reduced, more preferably at least about 50 percent reduced and most preferably at least about 75 percent reduced. As to final ash levels in the finished tar, in preferred processes the finished coal tar has an ash content of no greater than about 0.4 percent by weight, more preferably no greater than about 0.25 percent by weight, and most preferably no greater than about 0.15 percent by weight.

The high-speed centrifugation will also provide a finished tar having a QI level that is reduced as compared to the intermediate tar. Typically, at least about a 10 percent reduction in QI level is provided by the high-speed centrifugation, more preferably at least about a 25 percent reduction and most preferably at least about a 50 percent reduction. Preferred final QI levels in the finished tar are no greater than about 15 percent by weight, more preferably no greater than about 12 percent by weight, often falling within the range of about 4 to about 12 percent by weight.

Levels of other solid components in the intermediate tar will also typically be reduced by the high-speed centrifugation. For example, the finished tar will typically have a total solids level that is 50 percent or more reduced compared to the intermediate coal tar. Correspondingly, in typical runs about 10–15 weight percent of the total intermediate tar charged will be removed as sludge in the high-speed centrifugation. Thus, the finished tar usually represents about 85–90 weight percent of the charged intermediate coal tar.

The high-speed centrifugation is advantageously conducted in a solids-ejecting, disk-stack centrifuge such as that available from Alfa-Laval under Model No. CHPX513. Additional information as to such centrifuges suitable for use in the invention can be found in product literature from Alfa-Laval including literature entitled "CHPX" PB41113E, 8709.

The finished coal tar can be distilled using conventional techniques to produce one or more coal tar distillate fractions and binder pitch. Optionally, the finished coal tar can be reacted with formaldehyde prior to distillation so as to increase the yield of pitch obtained from the distillation, as disclosed in copending U.S. patent application Ser. No. 07/832,425 filed Feb. 7, 1992.

The sludge fractions removed from the coal tar in the first and second centrifugations (typically containing about 25 weight percent or more solids, e.g. about 25–50 weight percent solids) are preferably fed at a temperature of above about 50° C., more preferably in the range of about 50°–150° C. and most preferably about 80°–130° C., to a thermal desorption unit such as a gas-fired system or hot oil system. Natural-gas-fired thermal desorption units such as rotary calciners (indirectly-fired) or rotary kilns (directly-fired) are preferred. As with the coal tar fractions, it is advantageous to handle and feed the sludge while it retains at least a portion of the heat imparted during the centrifugation steps and preferably while it substantially retains such heat. The rotary calciner or kiln or other thermal desorption unit is operated so as to vaporize volatile components of the sludge to produce an overhead coal tar distillate and a dry solid carbonaceous material. The condensed materials can be conventionally used as a coal tar distillate. The dried, solid, friable free flowing material exiting the thermal desorption unit has good fuel value and is suitable for use in various industries as a source of coal related raw material.

For an example of a rotary calciner which can be used in the invention, reference can be made to U.S. Pat. No. 4,961,391. To process the sludge in accordance with the invention, such a rotary calciner is operated at a temperature and with a solids residence time sufficient to remove the volatiles from the sludge and leave a dry carbonaceous product. Preferred calciner runs are about 15 to about 120 minutes in duration at a temperature of about 250° C. to about 450° C. Such rotary calciners and similar thermal desorption units have been discovered to be suitable generally for the processing of coal tar sludges and thus the present aspect of the invention is not specifically limited as to the source of the coal tar sludge.

To promote a further understanding of the invention and its advantages, the following specific examples are provided. It will be understood that these examples are illustrative and not limiting in nature. In these examples and elsewhere in this application, levels of coal tar components are given in percent based upon the amount of tar present (e.g. excluding any added solvent).

EXAMPLE 1

The coal tar starting material for this example was a coke oven coal tar having the following characteristics:

| | |
|---|---|
| % $H_2O$ | trace |
| Sp. gr. at 60/60° F. | 1.267 |
| % Q.I. | 22.84 |
| % Ash | 1.01 |
| Viscosity cps at 190° F. | 850 |

This material was heated to about 90°–130° C. and fed to a decanter centrifuge Model No. P660 "Super-D-Canter" from Alfa-Laval. The coal tar was centrifuged at a temperature in the range of 90° C. to 130° C. at a centrifugal force of about 2500–3100 G's until separation had been achieved and a coal tar centrifugate was obtained having the following characteristics:

| | |
|---|---|
| % $H_2O$ | trace |
| Sp. gr. at 60/60° F. | 1.245 |
| % Q.I. | 13.75 |
| % Ash | 0.87 |
| Na (ppm) | 61 |
| Fe (ppm) | 660 |
| Si (ppm) | 2320 |
| Viscosity cps at 190° F. | 430 |

This intermediate tar was blended with 50 percent by volume of coal tar distillate to form a material having the following characteristics:

| | |
|---|---|
| % $H_2O$ | dry |
| Sp. gr. at 60/60° F. | 1.179 |
| % Q.I.* | 9.39 |
| % Ash* | 0.40 |
| Na (ppm) | N/A |
| Fe (ppm) | N/A |
| Si (ppm) | N/A |
| Viscosity cps at 70° F. | 490 |
| Viscosity cps at 190° F. | 100 |

*Based on tar + distillate

This blended material was fed at 90°–130° C. to a Gyrotester Model, from Alfa-Laval, and centrifuged at about 6500 to about 7000 G's to achieve separation. The two effluents from the centrifuge had the following characteristics:

| | Effluent #1 | Effluent #2 |
|---|---|---|
| % $H_2O$ | dry | dry |
| Sp. gr. at 60/60° F. | 1.171 | N/A |
| % Q.I.* | 5.91 | 8.17 |
| % Ash* | 0.15 | 0.41 |
| Na (ppm) | 13 | 24 |
| Fe (ppm) | 90 | 200 |
| Si (ppm) | 380 | 910 |
| Viscosity cps at 70° F. | 505 | N/A |
| Viscosity cps at 190° F. | 62 | N/A |

*Based on tar + distillate

Effluent 1 provides a quality coal tar suitably used in the preparation of binder pitch.

The wet solids (centrifuge sludge) from a decanter centrifuge run of the invention, such as that described above, were dried in a pilot scale rotary calciner such as that described in U.S. Pat. No. 4,961,391 for one hour at 300° C. The calciner was equipped with a vapor line leading to a partial condenser (a U-Tube water-cooled condenser). The condensed liquids from the condenser were fed to a storage vessel, and the non-condensables from the condenser were fed to a wet scrubber and vented to atmosphere. The characteristics of the wet solids feed and dried solids product recovered from the calciner drum were as follows:

| | Wet Solids | Dried Solids |
|---|---|---|
| % Ash | 3.09 | 4.69 |
| Specific Gravity 25/25° C. | 1.31 | N/A |
| % Coking Value | 52.40 | 82.42 |
| Na (ppm) | 200 | 370 |
| Fe (ppm) | 1,990 | 4,885 |
| Si (ppm) | 7,450 | 11,060 |
| Sulfide (ppm) | N.D. | 0.78 |
| Chloride (ppm) | <14 | <16 |
| Cyanide (ppm) | 5.29 | 1.36 |
| B.T.U./LB | 15,532 | 15,126 |
| % S | 0.75 | 0.73 |
| % C | N/A | 86.22 |
| % H | N/A | 3.80 |
| % N | N/A | 0.99 |
| % O | N/A | 1.63 |

The overall yields of dried solids, distillate and water were 69.01 percent, 22.78 percent and 5.92 percent, respectively. The condensed liquids (distillate oil) recovered from the partial condenser had the following chemical composition:

| | % |
|---|---|
| Phenol | 0.55 |
| Naphthalene | 16.48 |
| 1-methylnaphthalene | 1.95 |
| 2-methylnaphthalene | 0.88 |
| acenaphthene | 2.63 |
| Dimethylnaphthalenes | 3.39 |
| Fluorene | 4.07 |
| Phenanthrene | 17.49 |
| Anthracene | 5.45 |
| Carbazole | 2.30 |
| Fluoranthene | 9.71 |
| Pyrene | 7.72 |

EXAMPLE 2

The starting material for the runs in this example was a high-solids coke oven coal tar substantially similar to that in Example 1 and containing about 0.9 weight percent ash and about 20 weight percent QI components.

In several runs, samples of the coke oven coal tar were subjected to centrifugation in a decanter centrifuge as in Example 1 at a centrifugal force of about 3100 G's and a temperature in the range of about 87° C. to about 114° C. The decanter centrifuge separated the coke oven coal tar into a coal tar sludge and an intermediate coal tar having an ash content of about 0.5 weight percent and a QI content of about 15–16 weight percent. The intermediate coal tar samples were subjected to centrifugation in a disk-stack centrifuge at about 7000 G's as in Example 1, at a temperature in the range of about 93° C. to about 104° C. The disk stack centrifuge separated the intermediate coal tar into a finished coal tar product and a coal tar sludge. The finished coal tar had an ash content in the range of about 0.13 to about 0.25 weight percent and a QI component content in the range of about 9 to about 11 weight percent.

In accordance with additional aspects of the invention, the finished coal tar is distilled to distillate and pitch, and the coal tar sludges from the centrifugation steps are treated separately or together in a thermal desorption unit as in Example 1 to recover a dry carbonaceous fuel value product and a coal tar distillate.

EXAMPLE 3

The runs in this example employed, as starting material, a coal tar having high QI content and about normal ash content. The starting coal tar had an ash content of about 0.1 weight percent and a QI content of about 12.2 weight percent.

In several runs, samples of the coal tar were subjected to centrifugation in a decanter centrifuge as in Example 1 at a centrifugal force of about 3100 G's. A coal tar sludge, and an intermediate coal tar having an ash content of about 0.04 weight percent and a QI content of about 10–12 weight percent were recovered from the decanter centrifuge. The intermediate coal tar samples were subjected to centrifugation in a disk-stack centrifuge at about 7000 G's as in Example 1. The disk stack centrifuge separated the intermediate coal tar samples into a finished coal tar product and a coal tar sludge. The finished coal tar samples had ash contents in the range of about 0.01 to about 0.005 weight percent and a QI component contents in the range of about 4 to about 6 weight percent.

As above, in accordance with additional aspects of the invention, the finished coal tar can be distilled to distillate and pitch, and the coal tar sludges from the centrifugation steps can be treated separately or together in a thermal desorption unit as in Example 1 to recover a dry carbonaceous fuel value product and a coal tar distillate.

EXAMPLE 4

In this example, samples of the high solids coal tar, HS-1 (see above), were each subjected to a single high speed centrifugation to provide a coal tar suitable for distillation to binder pitch. Thus, samples of the HS-1 tar were subjected to centrifugation in a Gyrotester Model disk-stack centrifuge from Alfa-Laval. The tar was blended 50/50 on a weight basis with a coal tar distillate oil for the centrifugation, which centrifugation was conducted at 10000 G's and a temperature of 190° C. so as to provide a coal tar and a coal tar sludge having the following characteristics on average:

| | Coal Tar | Coal Tar Sludge |
|---|---|---|
| % Q.I.* | 4.32 | N/A |
| % Q.I. based on tar | 8.65 | N/A |
| % Ash* | 0.06 | 1.71 |
| % Ash based on tar | 0.12 | N/A |
| Fe (ppm) | 46 | 1590 |
| Si (ppm) | 180 | 4920 |
| Na (ppm) | 10.3 | 175 |
| % S* | 0.38 | 0.61 |
| B.T.U./LB | N/A | 15,926 |
| Chloride | N/A | <540 |
| Sulfide | N/A | 43.55 |
| Cyanide | N/A | 0.39 |

*Based on tar + distillate

Upon distillation of the coal tar, an anode binder pitch having the following characteristics was obtained:

| | |
|---|---|
| Softening point Miltler °C. | 105.0°C. |
| % Q.I. | 12.14 |
| % Ash | 0.215 |
| % Yield based on tar | 66.3 |

The coal tar sludge can be treated by a thermal desorption unit as in Example 1 to recover a coal tar distillate and a dry carbonaceous coal-related product.

All publications cited herein are hereby incorporated by reference in their entirety as if each had been individually incorporated by reference and fully set forth.

While the invention has been illustrated and described in detail in the foregoing description, the same is to be considered as illustrative and not restrictive in character, it being understood that only the preferred embodiment has been described and that all changes and modifications that come within the spirit of the invention are desired to be protected.

What is claimed is:

1. A process for treating an ash-containing coal tar in sequential Centrifugation steps to remove ash therefrom and produce a coal tar suitable to form a binder pitch, comprising the steps of:

subjecting an ash-containing coal tar starting material having an ash content of greater than about 0.6 weight percent to centrifugation at a centrifugal force of about 2000 to about 4000 G's, said centrifuging being effective to separate the coal tar starting material into a first fraction which is an intermediate goal tar having a reduce level of ash as compared to the starting material and a second fraction having an increased level of ash as compared to the starting material;

recovering said intermediate coal tar; and subjecting said intermediate coal tar to one or more centrifugations, at least one of which is at a centrifugal force of about 5000 G's to about 10000 G's so as to separate the coal tar into a finished coal tar fraction having a reduced level of ash as compared to the intermediate coal tar and not greater than about 0.4 weight percent, said finished coal tar fraction having a QI component content of about 4 to about 12 weight percent and being effective upon distillation to form binder pitch, and a further fraction having an increased level of ash as compared to the intermediate coal tar; and recovering said finished coal tar fraction.

2. The process of claim 1 wherein said intermediate coal tar fraction is centrifuged at a centrifugal force of about 6000 G's to about 8000 G's.

3. The process of claim 2 wherein said centrifugation step at about 5000 G's to about 10000 G's is conducted with the intermediate coal tar at a temperature in the range of about 80° C. to about 130° C.

4. The process of claim 3, wherein said intermediate coal tar is blended with a solvent during said centrifugation step.

5. The process of claim 4 wherein the solvent is a coal tar distillate.

6. The process of claim 3 wherein said intermediate coal tar is devoid of added solvent during said centrifugation step.

7. The process of claim 1 wherein said finished coal tar fraction has an ash content of about 0.25 weight percent or less.

8. The process of claim 7 wherein said starting material has a QI content of greater than about 15 weight percent.

9. The process of claim 8 wherein said finished coal tar has a QI content of no greater than about 10 weight percent.

10. The process of claim 8 wherein the coal tar starting material is centrifuged in a decanter centrifuge and the intermediate coal tar is centrifuged in a solids-ejecting disk stack centrifuge.

11. A process for treating coal tar sludge, comprising:

providing a coal tar sludge which is a by-product of the treatment of a coal tar to remove solids therefrom, said coal tar sludge including at least 25% solids including coal tar ash, and coal tar-derived liquids including naphthalene and phenanthrene;

charging the coal tar sludge to a thermal desorption unit;

treating the sludge in the thermal desorption unit at a temperature of at least about 200° C. so as to remove volatile organic compounds therefrom including said naphthalene and phenanthrene;

condensing said volatile organic compounds to recover a coal tar distillate including naphthalene and phenanthrene; and recovering from the thermal desorption unit a dry carbonaceous product having fuel value.

12. The process of claim 11 wherein the sludge is treated in the thermal desorption unit at a temperature of at least about 250° C.

13. The process of claim 12 wherein the sludge charged to the thermal desorption unit has a solids content in the range of about 25 weight percent to about 50 weight percent.

14. The process of claim 13 wherein the thermal desorption unit is a rotary kiln or rotary calciner.

15. A process for producing binder pitch, comprising:

subjecting an ash-containing coal tar starting material having an ash content of greater than about 0.6 weight percent to centrifugation at a centrifugal force of about 2000 to about 4000 G's, said centrifuging being effective to separate the coal tar starting material into a first fraction which is an intermediate coal tar having a reduce level of ash as compared to the starting material and a second fraction having an increased level of ash as compared to the starting material;

recovering said intermediate coal tar; and subjecting said intermediate coal tar to one or more centrifugations, at least one of which is at a centrifugal force of about 5000 G's to about 10000 G's so as to separate the coal tar into a finished coal tar fraction having a reduced level of ash as compared to the intermediate coal tar and not greater than about 0.4 weight percent, said finished coal tar fraction having a QI component content of about 4 to about 12 weight percent and beings effective upon distillation to form binder pitch, and a further fraction having an increased level of ash as compared to the intermediate coal tar; and recovering said finished coal tar fraction; and distilling said finished coal tar fraction to produce binder pitch.

16. The process of claim 15 wherein the finished coal tar fraction which is distilled has an ash content no greater than about 0.15 percent.

17. The process of claim 16 wherein the finished coal tar fraction which is distilled has a QI component content of no greater than about 10 weight percent.

* * * * *

UNITED STATES PATENT AND TRADEMARK OFFICE

CERTIFICATE OF CORRECTION

PATENT NO : 5,534,137

DATED : July 9, 1996

INVENTOR(S) : E. Sean Griggs et al.

It is certified that error appears in the above-identified patent and that said Letters Patent is hereby corrected as shown below:

In col. 2, line 21, please delete "calcined" and insert in lieu thereof --calciner--.

In col. 11, line 23, please delete "Centrifugation" and insert in lieu thereof --centrifugation--.

In col. 11, line 30, please delete "goal" and insert in lieu thereof --coal--.

In col. 12, line 52, please delete "beings" and insert in lieu thereof --being--.

Signed and Sealed this

Twenty-fourth Day of August, 1999

*Attest:*

Q. TODD DICKINSON

*Attesting Officer*

*Acting Commissioner of Patents and Trademarks*